United States Patent [19]

Michaels

[11] Patent Number: 4,672,902

[45] Date of Patent: Jun. 16, 1987

[54] PNEUMATICALLY OPERATED THREAD CUTTER

[75] Inventor: Sidney Michaels, Fairlawn, N.J.

[73] Assignee: Clinton Industries, Inc., Carlstadt, N.J.

[21] Appl. No.: 887,422

[22] Filed: Jul. 21, 1986

[51] Int. Cl.[4] ..... D05B 65/06

[52] U.S. Cl. ..... 112/287; 112/DIG. 1; 83/100; 83/602

[58] Field of Search ..... 112/DIG. 1, 287; 128/310; 30/180; 83/100, 591, 592, 602, 607, 597, 600

[56] References Cited

U.S. PATENT DOCUMENTS

| | | | |
|---|---|---|---|
| 3,149,594 | 9/1964 | Buckreus et al. | 112/287 |
| 3,554,149 | 1/1971 | Diehm | 112/287 |
| 4,328,758 | 5/1982 | Souza et al. | 112/287 X |
| 4,596,243 | 6/1986 | Bray | 128/310 X |
| 4,599,960 | 7/1986 | Brusasca et al. | 112/DIG. 1 X |

*Primary Examiner*—Werner H. Schroeder
*Assistant Examiner*—Andrew M. Falik
*Attorney, Agent, or Firm*—McAulay, Fields, Fisher, Goldstein & Nissen

[57] ABSTRACT

A pneumatically operated thread cutter includes a cutter housing with a stationary blade and a movable blade which is moved by a pneumatic motor. A cutter housing has a chamber in which the movable blade is disposed and which is connected to a venturi mechanism which is receptive of a high pressure air input for creating a suction in the cutting housing chamber to draw a loose thread into the blades for cutting same.

4 Claims, 4 Drawing Figures

PNEUMATICALLY OPERATED THREAD CUTTER

BACKGROUND OF THE INVENTION

The present invention relates to a thread cutter for a sewing machine.

External drive thread cutter assemblies for commercial type sewing machines are known in the art, however, these cutters have been driven by mechanical linkages which work directly off the sewing machine motor. These mechanical linkages cause the blades in the cutter to operate at 6000 RPM which greatly reduces the life span of the blades and thus requires that the blades be replaced at frequent intervals. Another problem is that when the knife is inoperative or being replaced, the sewing machine is out of service causing lost time.

SUMMARY OF THE INVENTION

The main object of the present invention is to provide a thread cutter which overcomes the disadvantages of the mechanical linkage thread cutters now being used.

This and other objects of the present invention are achieved in accordance with the present invention by the use of an air motor which enables the blades to operate at 2000 RPM and therefore substantially increase their life span.

In accordance with the present invention, the air motor has a rotor at the end of which there is a link eccentrically connected to it. As the rotor of the air motor rotates, the link reciprocates back and forth and the link is connected to a cutter shaft so that as the link reciprocates, a movable blade of the cutter operates in a cutting action.

Furthermore, in accordance with the present invention a venturi member is mounted adjacent to the air motor and operates to produce a vacuum to pull the thread into the blades so that the blades can cut the thread. The material being sewn, is too thick to be pulled into the blade so that it simply passes over the blade.

These and other objects and advantages of the present invention will be seen from the following detailed description taken with the attached drawings, wherein:

DETAILED DESCRIPTION OF THE INVENTION

Figure 1:
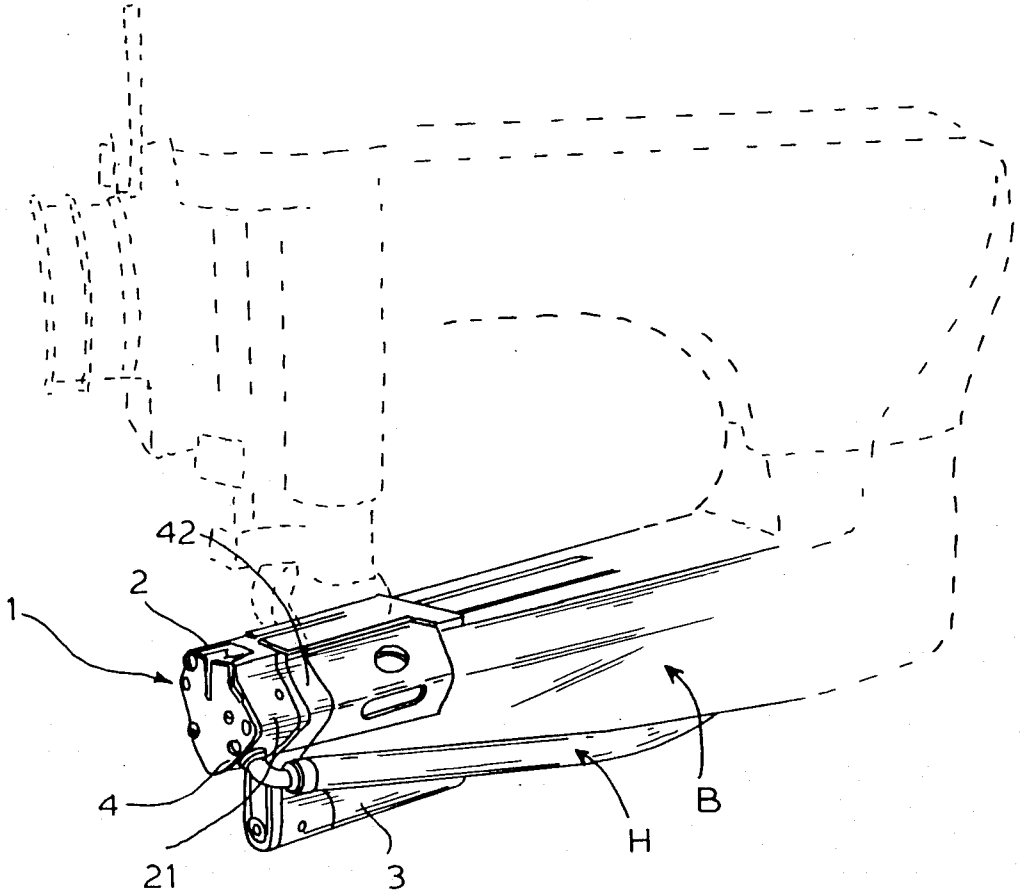
FIG. 1 is a perspective view showing the external thread cutter assembly attached to the base of a sewing machine.
Figure 2:
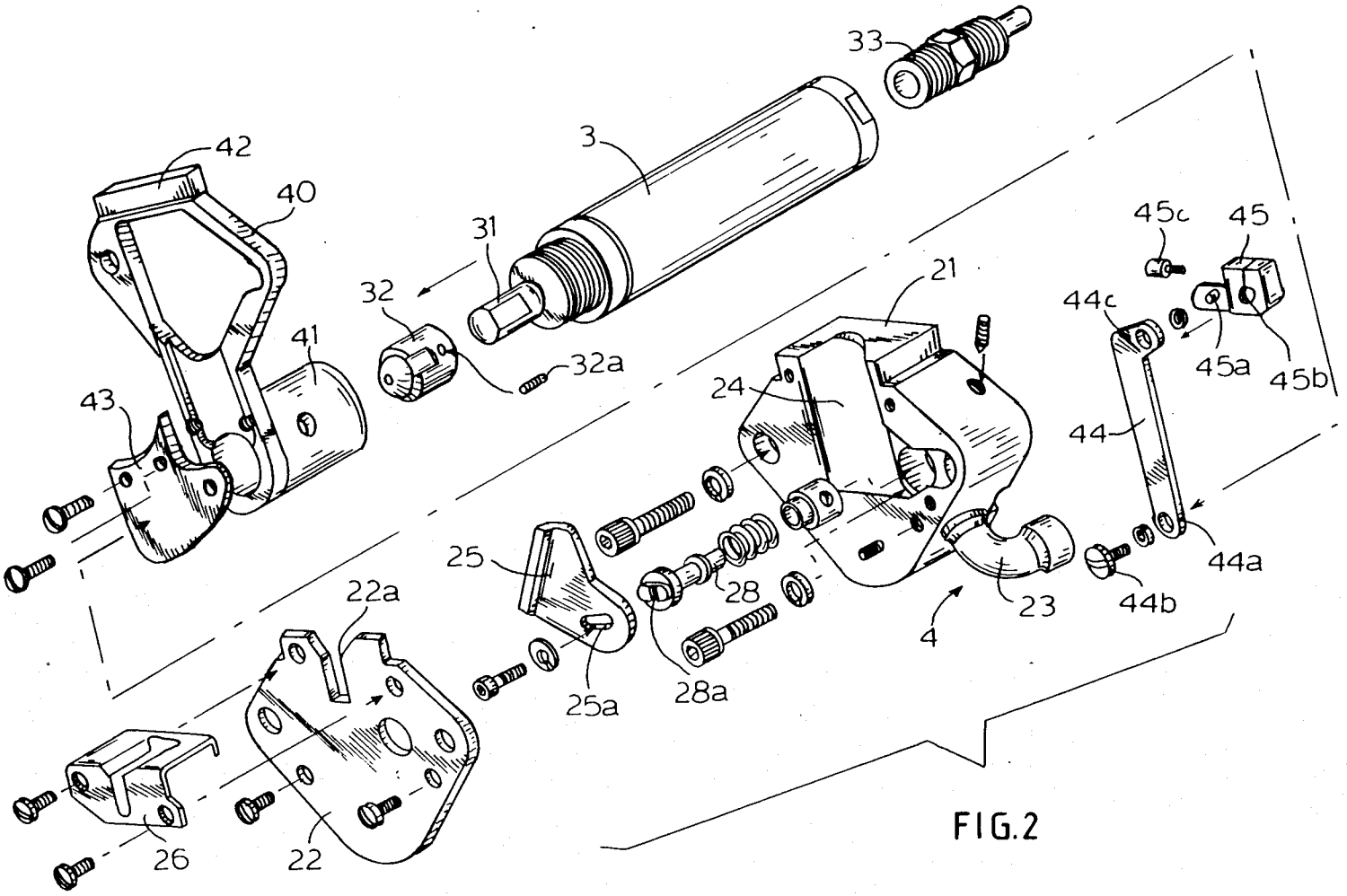
FIG. 2 is an exploded view of the cutter assembly according to the present invention.
Figure 3:
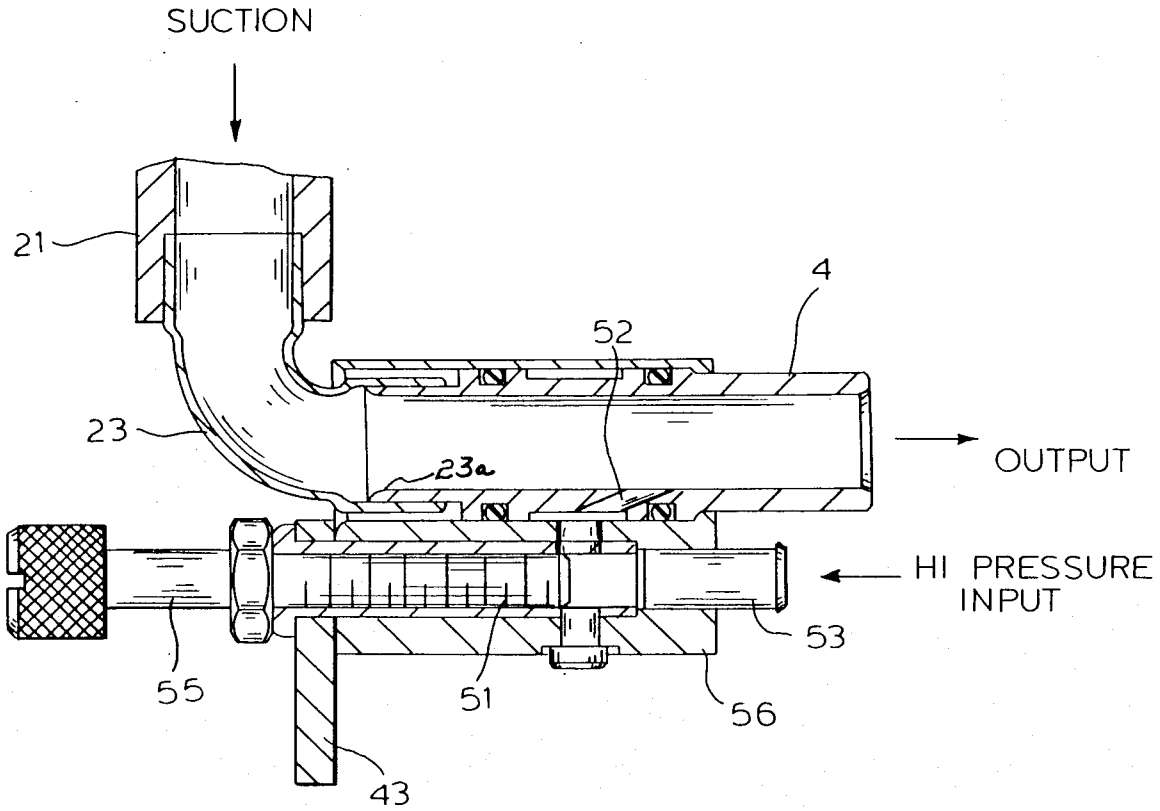
FIG. 3 is a sectional view of the venturi mechanism according to the present invention.
Figure 4:
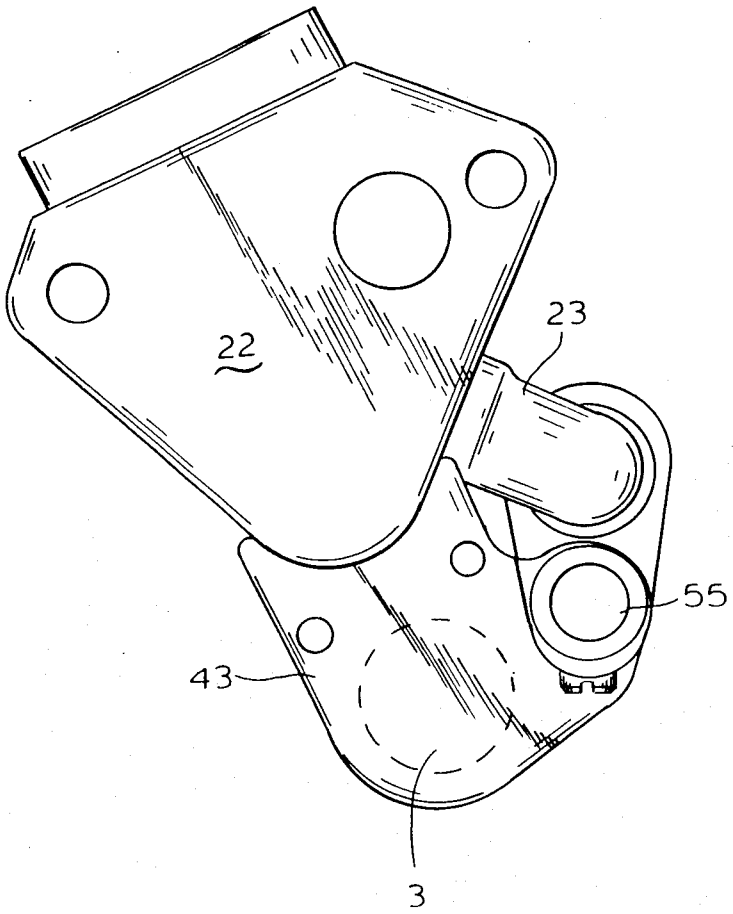
FIG. 4 is a side view of the device shown in FIG. 1.

Referring now to FIGS. 1–4, the thread cutter assembly 1 is mounted on the outside of the base B of a conventional commercial sewing machine such as a Union Special Model 36200 and includes a cutter assembly 2 and air motor 3 and the air and thread output tube 4 which is connected to a tube H added to the sewing machine. The air motor may comprise any conventional air motor such as Model MCI-0401 manufactured by Micro-Motors, Inc., 151 East Columbine Avenue, Santa Ana, Calif. 92707.

The thread cutter assembly 2 includes cutter housing 21 having an internal chamber 24 which communicates with elbow tube 23 and which has a movable blade 25 mounted therein and which is closed by member 22 which includes the stationary blade and which is covered by a guard 26 which enables the chamber 24 to be open at the top of housing 21. The elements are maintained together by screws, nuts and washers which are shown but are not labeled.

The movable blade 25 is moved relative to stationary blade **22*a* by air motor 3 which is receptive of a supply of air via fitting 33 and which has an output shaft 31 to which an eccentric 32 is mounted by set screw 32*a*. A spacer assembly 40 is provided which has a cylindrical portion 41 receptive of the eccentric 32 and a top portion 42 which is connected to housing 21. A guard member 43 is attached to the outside of spacer assembly 40. Eccentric 32 is linked to blade 25 by link 44 having one end 44*a* connected via screw 44*b* to eccentric 32. Eccentric 32 causes link 44 to move in a reciprocating manner and end 44*c* of link 44 is connected to drive arm 45 via pin 45*a***.

Drive arm 45 acting as an oscillating means for the blade 25 is connected to blade 25 by shaft 28, which rotates in bore **45*b* and is adjustably locked thereon via screw 45*c*. Shaft 28 engages blade 25 by fitting 28*a* which engages slot 25*a*. The reciprocating movement of link 44 causes movement of blade 25 across stationary blade 22*a*. That is, the shaft 31 of the air motor is rotated in the conventional manner. As the eccentric 32 rotates, the link 44 is reciprocated to oscillate the shaft 28**.

The venturi mechanism is connected via elbow 23 and tube **23*a* (see FIG. 3) and includes suction tube designated generally by the reference character 4, and includes a tube 23*a* in a venturi housing 56 which also encloses a barb tubing 53 receptive of high pressure compressed air input of 60–100 psi, and a needle valve body 51 with a needle valve assembly 55. The needle valve is connected to the air output tube 23*a* via a passage 52 and the high pressure input at barb tubing 53 causes suction to be created in tube 23*a* and therefore elbow 23 and thereafter housing chamber 24**.

It will be appreciated that the instant specification and claims are set forth by way of illustration and not limitation, and that various modifications and changes may be made without departing from the spirit and scope of the present invention.

What is claimed is:

1. A pneumatically operated thread cutter comprising: a cutter housing having a top, a chamber open at the top, a stationary blade connected to the housing and a movable blade mounted in the chamber and coactive with the stationary blade to cut a thread, a pneumatic motor mounted on said housing receptive of a supply of air, an eccentric linkage connected to the output of the motor and to the movable blade for moving the blade when the motor rotates, said eccentric linkage including reciprocating means for converting the rotational motion of said pneumatic motor into reciprocating motion, and oscillating means connected between said reciprocating means and said movable blade for converting said reciprocating motion into oscillatory motion of said movable blade.

2. A pneumatically operated thread cutter as in claim 1, including a venturi means receptive of a high pressure air input and communicating with the chamber in the cutter housing for creating suction in the cutting housing chamber to draw a loose thread into the blades for cutting same.

3. The thread cutter according to claim 2, wherein the venturi means comprises an air tube in communication with the chamber in the cutter housing, a needle valve receptive of an air input and a passage connecting the needle valve with the air tube.

4. The thread cutter according to claim 1, in which said housing is sized and positioned to be attached to a sewing machine adjacent the sewing station thereof.

* * * * *